United States Patent [19]

Noecker et al.

[11] 3,959,926

[45] June 1, 1976

[54] TILT WINDOW

[75] Inventors: Marshall V. Noecker, Grosse Pointe; Kenneth C. Thom, Birmingham; Charles Harp, Jr., Farmington, all of Mich.

[73] Assignee: Kaufmann Window and Door Corporation, Detroit, Mich.

[22] Filed: Oct. 2, 1974

[21] Appl. No.: 511,291

[52] U.S. Cl. ..... 49/181; 49/450; 49/453; 49/463; 49/504

[51] Int. Cl.[2] ..... E06B 3/32; E06B 1/04

[58] Field of Search ..... 49/181, 450, 453, 455, 49/456, 446, 463, 504; 52/204; 24/248

[56] References Cited

UNITED STATES PATENTS

| | | | |
|---|---|---|---|
| 1,596,450 | 8/1926 | Rappaport | 49/456 |
| 2,611,462 | 9/1952 | Price | 49/450 |
| 2,778,068 | 1/1957 | Kaufman et al. | 49/181 |
| 3,055,062 | 9/1962 | Peters et al. | 49/181 |
| 3,208,111 | 9/1965 | Grossman | 49/453 |
| 3,434,236 | 3/1969 | Weidner et al. | 49/181 |
| 3,451,168 | 6/1969 | Pengelly | 49/463 |
| 3,795,076 | 3/1974 | Anderson | 49/504 |
| 3,810,332 | 5/1974 | Grossman | 49/450 |
| 3,861,082 | 1/1975 | Dau | 49/181 |

FOREIGN PATENTS OR APPLICATIONS

| | | | |
|---|---|---|---|
| 1,434,974 | 4/1970 | Germany | 49/453 |

*Primary Examiner*—Paul R. Gilliam
*Assistant Examiner*—Victor N. Sakran
*Attorney, Agent, or Firm*—Woodhams, Blanchard and Flynn

[57] ABSTRACT

Tiltable window construction having metallic sash and frames. There is disclosed a window construction adapted for manufacture from metallic components such as extruded aluminum, arranged for embodiment as a double-hung window, capable of simple and rapid tilting inwardly of the building for washing and/or other treatment. The sash are also capable of quick and easy removal in their entirety from the window frame but are tightly and reliably sealed thereto when in use for the effective prevention of the entry of wind and water. Each sash of the window is held by simple latch mechanism in normal sliding condition and when tilted inwardly automatically becomes locked into the then-existing position. Other features include easy adaptability to placement of a fixed sash within a given frame for use with the movable sash, for relating to an adjacent picture window or other windows, adapted for closing an otherwise relatively large window opening in the building and for quick and easy adjustment to fit and be properly aligned in a window opening whose sides are slightly concave.

13 Claims, 15 Drawing Figures

TILT WINDOW

FIELD OF THE INVENTION

This invention relates to window construction and particularly to a type thereof capable of easy and convenient tilting of the window sash inwardly for washing of both the interior and exterior sides thereof and for easy removal of each sash from the remainder of the window, together with a high degree of sealing when the window sashes are in place. The window construction also has a number of features enabling it to be easily and quickly fitted into a preexisting window opening, thus enabling it to be used as a replacement window in a brick building, as well as numerous features enabling it to be used in a variety of combinations with other desired windows, such as picture windows and the like.

BACKGROUND OF THE INVENTION

While it has been long known to provide windows of the double-hung type which are also capable of tilting inwardly for convenient washing thereof, at least some of such constructions insofar as we are acquainted with them have usually involved the tilting and/or complete removal of portions of the window frame or they have suffered from a lack of acceptably tight sealing. Others of such tilt-type windows have involved excessively complex manipulations to effect the desired tilting and still others of them have not been readily conducive to manufacture from metallic sash and frame components. However, the speed of fabrication and resulting economy of windows made from metallic sash and frame components has long been recognized, together with the minimal maintenance characteristic of such windows, and hence it has long been desirable to provide a commercially acceptable window of the generally double-hung type, using metallic sash and frame components, capable of simple and easy tilting inward for cleaning but which will be sealed firmly against the entry of wind and water when in operating position.

Further, in order to adapt such a window to an extremely large market existing in older cities, or older parts of cities, wherein window openings especially for brick buildings already exist, exist in endless varieties of widths and heights, and are not readily modifiable, it is desirable to provide in addition a window construction which can be readily combined with other similar window units or combined with picture window or other related window units in a total window assembly for a single window opening and to do so quickly, reliably and without sacrifice in the speed and convenience by which same may be assembled or in the speed and versatility with which same may be associated with other similar or related units for fitting into building openings as required.

SUMMARY OF THE INVENTION

The invention provides a window frame having sealing and sliding surfaces built both parallel to the plane of the window opening and perpendicular thereto. The window is pivotally mounted near the bottom thereof in a vertically sliding unit, such mounting being through pivotal means including cam means whereby when the window is in its normal position it is free for vertical sliding movement but when same is tilted to approximately 90° with respect to the plane of the window opening the cam operates to move the sliding members tightly against the adjacent frame surfaces for holding same firmly in place. This permits the window to be tilted out of the plane of the frame structure and positioned firmly in a predetermined location for convenient washing or other treatment. Simple spring-loaded latch means hold same in normal operating position and are arranged to facilitate vertical sliding thereof. Easily removable pin structure connects the lower portion of each window sash to said cam means whereby upon retraction of said pins and the latch means the window may be removed in its entirety from the frame structure for repair or other attention as desired.

Subsidiary but important features include easily manipulated means for effecting appropriate alignment of the window frame with respect to the surrounding window opening, for connecting a window unit with other similar units by easily inserted and fixed connecting members and for relating the vertically movable double-hung sash with fixed sash units if and when desired to meet a given building situation. These and other features providing the window construction with a high level of reliability together with versatility and adaptability will be further developed below.

DETAILED DESCRIPTION

Figure 1:
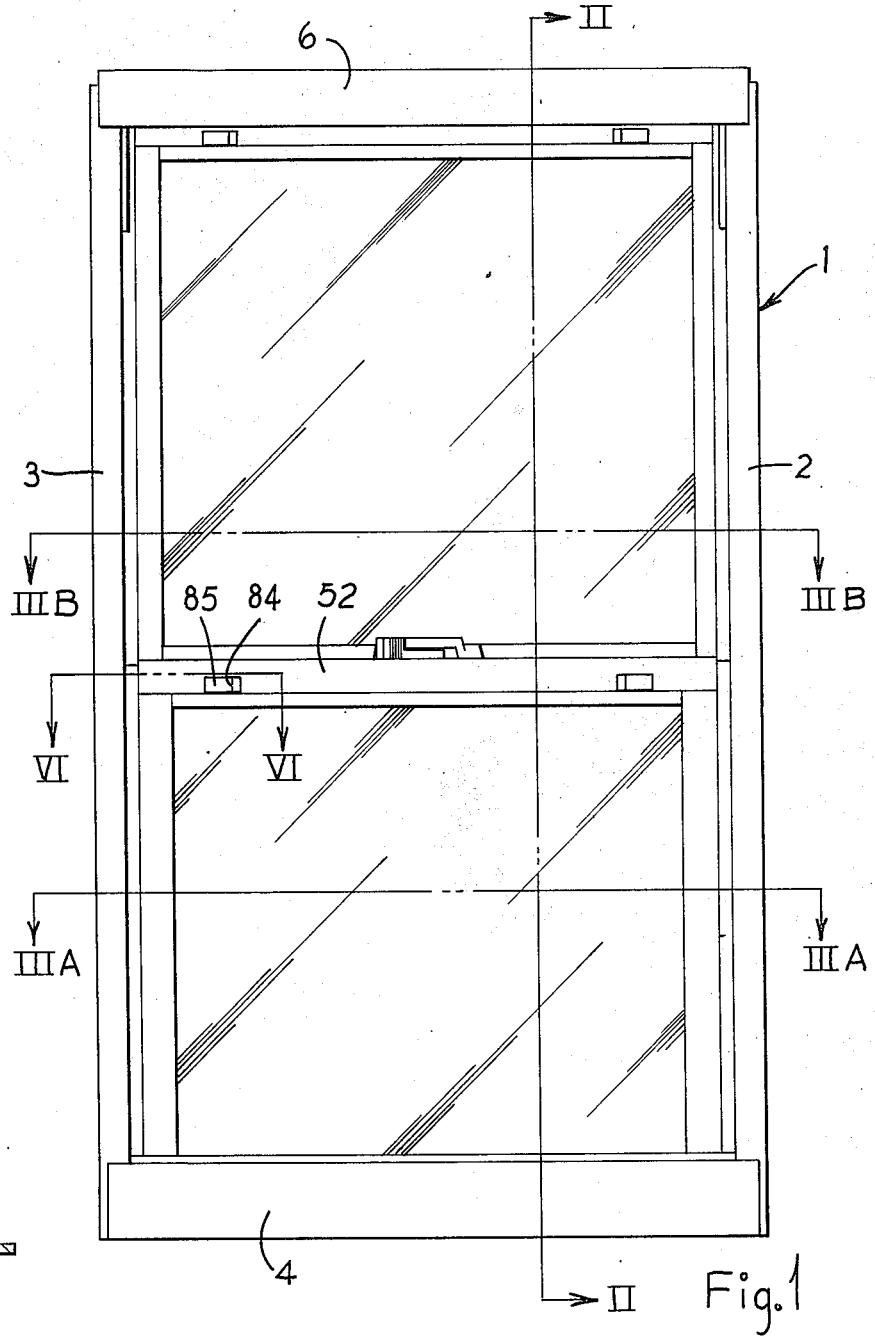
FIG. 1 is an elevation view of a window embodying the invention as seen from the inside of the building in a normal installation.
Figure 3A:
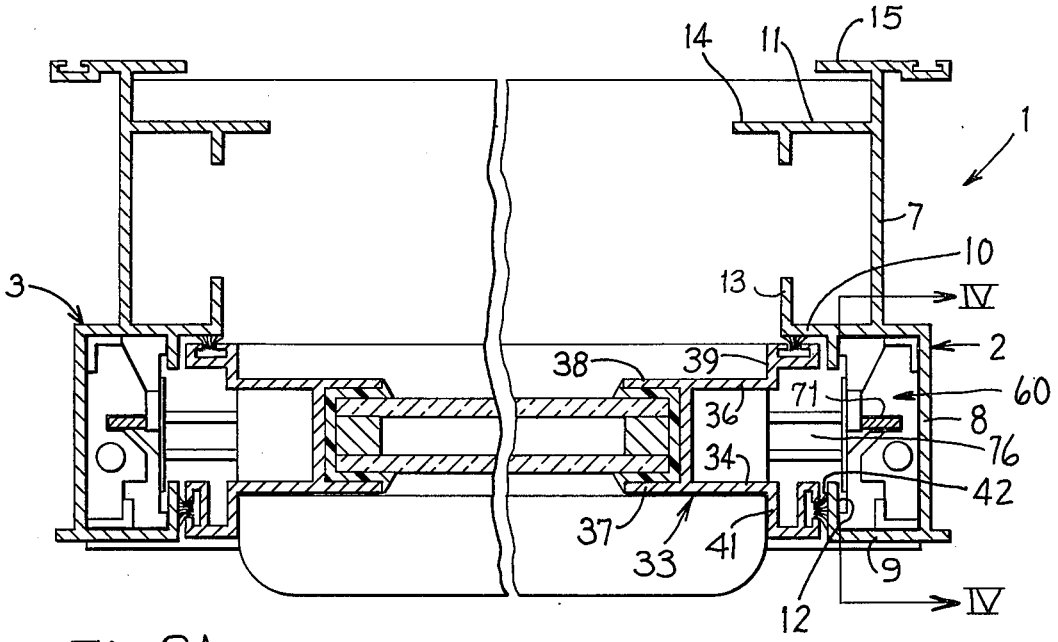
FIG. 3A is a broken section taken on the line IIIA—IIIA of FIG. 1.
Figure 3B:
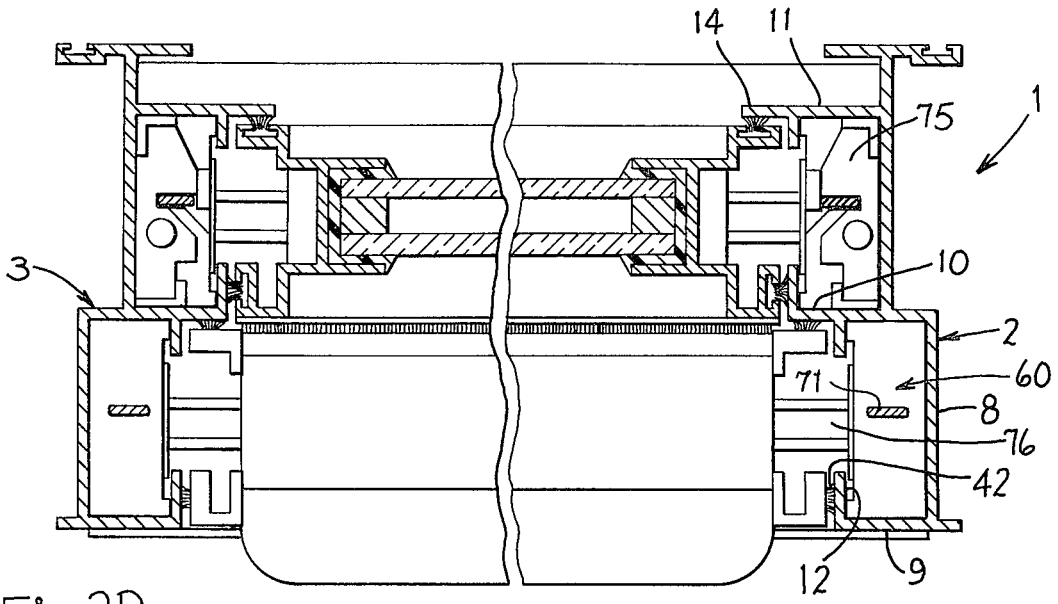
FIG. 3B is a broken section taken on the line IIIB—IIIB of FIG. 1.

Referring now to the drawings, there is provided a window frame 1 (FIG. 1) comprising stiles 2 and 3 together with a sill 4 and header 6. The stiles 2 and 3 are made in any convenient manner and of any convenient material but in this embodiment are preferably made from extruded aluminum. As shown, same comprise a stepped side plate comprising sections 7 and 8 with an inside flange 9, a middle flange 10 and an outside flange 11 (FIGS. 3A and 3B, also FIG. 11, wherein for clarity the frame is shown without associated sash or slide components). Said inside flange 9 has a contact flange 12 at its free end extending perpendicularly to the plane of the window, said middle flange 10 has a similar contact flange 13 extending perpendicularly to the plane of the window at its free end while the outside flange 11 has a contact portion 14 extending parallel to the plane of the window. A flange 15 extends from a projection of section 7 and is parallel with outside flange 11.

The stile 3 is constructed in mirror image to the stile 2 and hence needs no further or detailed description.

The sill 4 (FIG. 2) comprises a horizontal portion 16 and a sloped portion 17 together with an inside upstanding vertical flange 18 and a downwardly extending outside vertical flange 19. Suitable conventional means such as the inside flange 21 and the angle member 22 are provided for appropriately associating said sill with the building construction such as a brick wall.

The header 6 (FIG. 2) comprises a horizontal portion 23 together with appropriate upstanding flanges 24 and 25 for associating same with the building wall and downwardly extending flanges 26–30. The flange 26 aligns with and completes the surface defined by the inside flanges 9 of the stiles, and the flange 29 aligns with and completes the surface defined by the flanges 15 of the stiles. The flange 27 is positioned somewhat outside of the middle flange 10 of the stile and the flange 28 is aligned with and completes the surface defined by the outside flange 11 of the stile. The flange 27 in this embodiment is provided with a sealing strip 31 received into a suitable recess therein.

Figure 2:
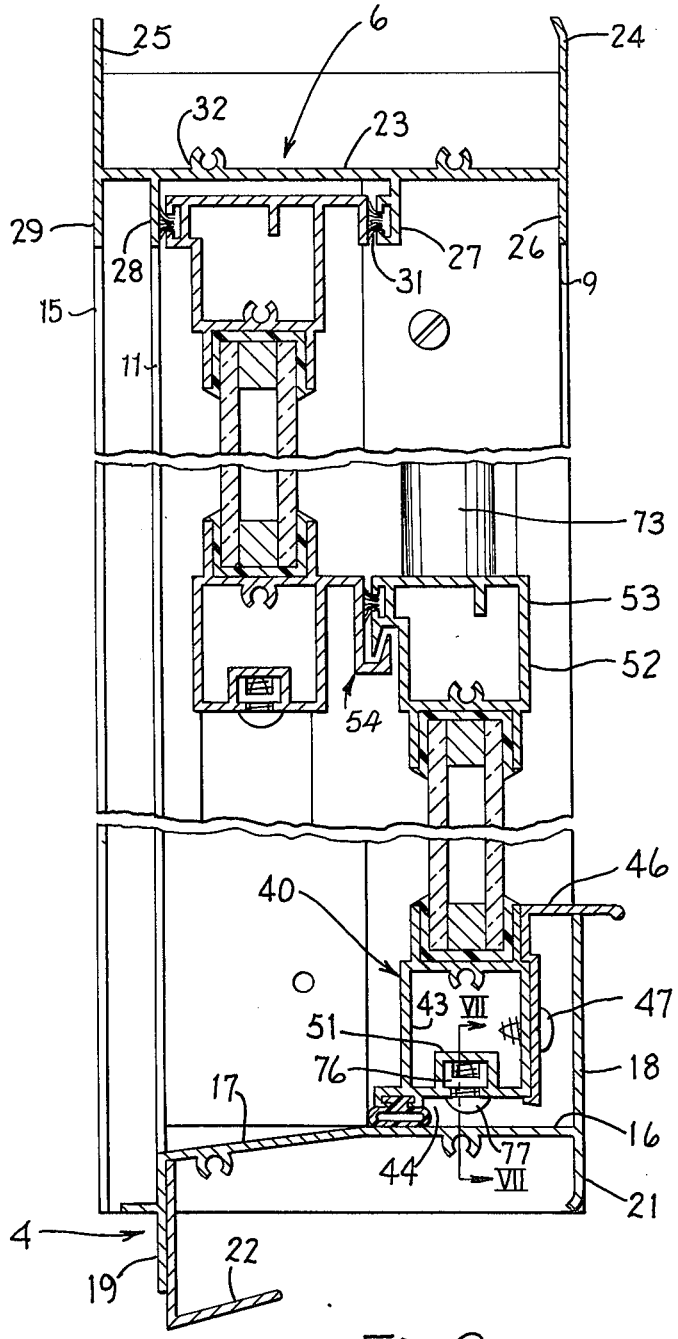
FIG. 2 is a broken section taken on the line II—II of FIG. 1.

The corners of the frame members are fixed together in any convenient manner, such as by the inclusion of screw receiving means as indicated at 32 in FIG. 2 for the reception of screws passing through the stiles, as shown in more detail in application Ser. No. 364,372 assigned to the same assignee as the present application.

Turning now to the sash members and giving attention first to the lower sash member (FIGS. 2 and 3A), same includes vertical members 33 which are generally H-shaped having outer legs 34 and 36 for engagement with the frame and inner legs 37 and 38 for holding the sash panel. The inner legs are spaced appropriately for holding single or double glazing as desired, the mounting of which may be conventional and forms no part of the present invention. The outwardly facing leg 36 preferably has an offset portion 39 having a recess for holding a sealing strip facing outwardly to bear against the inwardly facing sealing surface of the middle flange 10 and the inwardly facing leg 34 likewise has an offset portion 41 carrying a laterally facing recess for holding a sealing strip 42 bearing against the opposed sealing surface of the flange 12. The opposite side of the lower sash is provided with a similar vertical member having similarly arranged sealing strips which are mirror images of those just described and hence need no further or detailed description.

The bottom cross member 40 of the lower sash comprises a generally box-shaped portion 43 with a recess for a downwardly directed sealing strip 44 and upstanding flanges of conventional form for holding single or double glazing as desired. A sill member 46 is preferably made separate from the bottom cross member 40 in order to accommodate same to specific window designs as required but may be made integrally therewith if preferred. This component is in this embodiment separate and fastened to the bottom cross member 40 by suitable means such as metal screws of which one is shown at 47. The bottom cross member 40 also contains an internal sidewardly opening boxlike portion 51 for purposes appearing further hereinafter.

The upper cross member 52 comprises a box section 53 of generally similar size and shape to the box-shaped portion 43 and downwardly extending glazing receiving flanges which likewise receive the glazing, single or double as desired and in any convenient and conventional manner. Conventional interlocking of said upper cross member 53 may be provided at 54 if desired.

Figure 5:
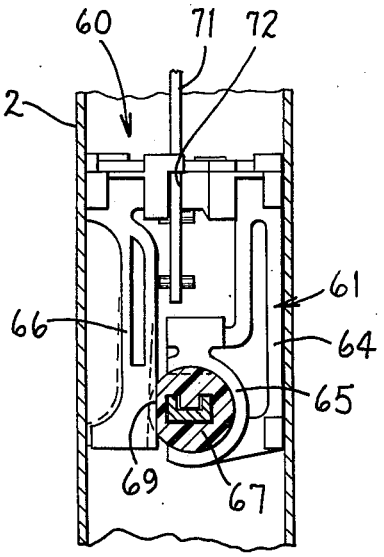
FIG. 5 is a section taken on the same plane as FIG. 4 but showing a different operational position.
Figure 8:
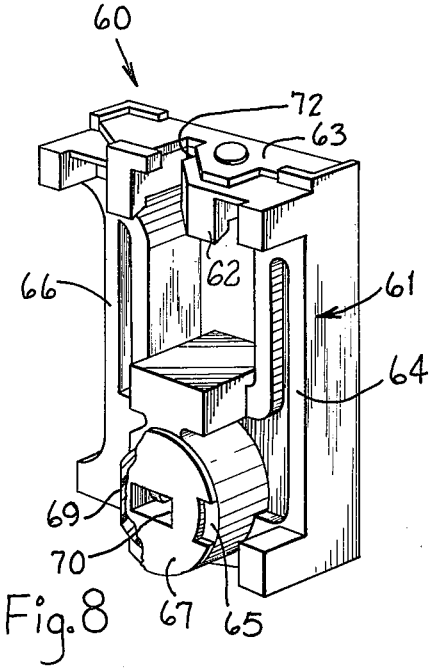
FIG. 8 is an oblique view of the slide means shown removed from its position of operation within the frame.

Turning now to the means by which said lower sash is mounted into the frame, attention is first directed toward the slide, or sash support, unit 60 shown separately for purposes of clarity in FIG. 8. Said unit comprises a cross member 62 backed for purposes of strength if desired by a metal strip 63 and having downwardly extending legs 64 and 66. A rotatable spreader, or cam, member 67 is received into a suitable cavity in the bearing portion 65 of the leg 64 and is provided with a flat side 69 thereon which, when in the position shown in FIG. 5, permits the leg 66 to move into the solid line position also shown in FIG. 5. This enables the sash support unit 60 to move vertically between the flanges 9 and 10 of the side stile 2 but when said cam member 67 is rotated the leg 66 is moved into the dotted line position of FIG. 5, bears brakingly against said flanges 9 and 10 and holds same firmly against vertical movement. A rod 71 enters into a slot 72 in the cross member 62 and is at its upper end received into the cylinder 73 (FIG. 2) of a conventional spring-type balance means for said window. Said balance means are well known and hence need no detailing, it being sufficient to say that same exerts a constant upwardly directed force on the rod 71 by spring means contained within said cylinder and thus tends constantly to balance the weight of the window.

A similar sash support unit is provided also on the opposite side of the lower sash.

Figure 4:
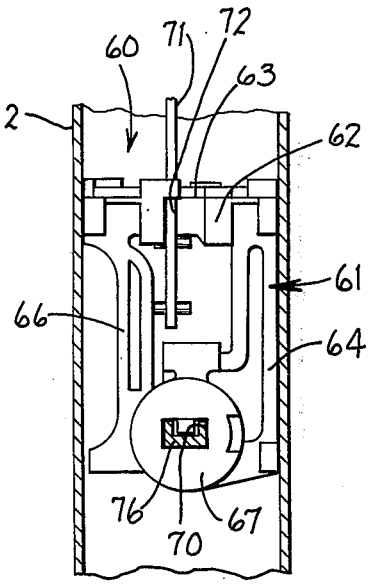
FIG. 4 is a fragmentary section taken on the line IV—IV of FIG. 3.

Returning now to the lower bottom cross member 40 of the lower sash, attention is directed again toward the boxlike portion 51 in the bottom thereof. Slidably received within this portion is a U-shaped member 76 which extends sidewardly beyond the sash and projects into the rectangular opening 70 in the cam member 67 shown in FIG. 4. A screw 77 may be turned into the U-shaped member 76 and upon tightening of the latter will fix the U-shaped member in any adjusted position. Said U-shaped member thus comprises the connection between the bottom sash cross member 40 and the cam member 67 and thereby to the sash support unit 60.

The upper sash is constructed in essentially the same manner as the lower sash excepting only that the legs corresponding to the legs 34 and 36 of the lower sash are in the upper sash considerably shorter. This permits the upper sash to be inset somewhat at its outer perimeter from the corresponding perimeter of the lower sash but permits the light thereof to be of the same dimensions as that of the lower sash. The bottom of the upper sash fits into a vertically slidable sash support unit 75 identical with the vertically slidable sash support unit 60 above described with respect to the lower sash, is fastened thereto in the same manner and functions therewith in the same manner.

Figure 9:
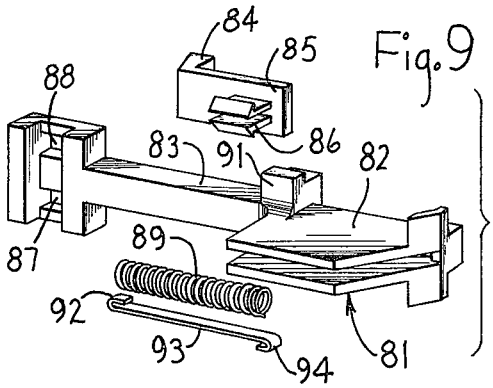
FIG. 9 is an exploded view of the latch means.

Returning now to the lower sash and looking at the upper cross member 52 thereof, there is located slidably therein a latch member 81. Same is preferably made from a molded plastic material, for example a self-lubricating plastic such as nylon. Said latch member 81 is illustrated separately in FIG. 9 for clarity and comprises a latch portion 82 and a slide portion 83. Said slide portion 83 has a handle extension 84 which (returning to FIG. 1) extends through an opening in the upper cross member 52 for engagement thereof by an operator. Resilient means 89 are further provided for constantly urging said latch member 81 laterally outwardly beyond the periphery of said lower sash member.

Figure 6:
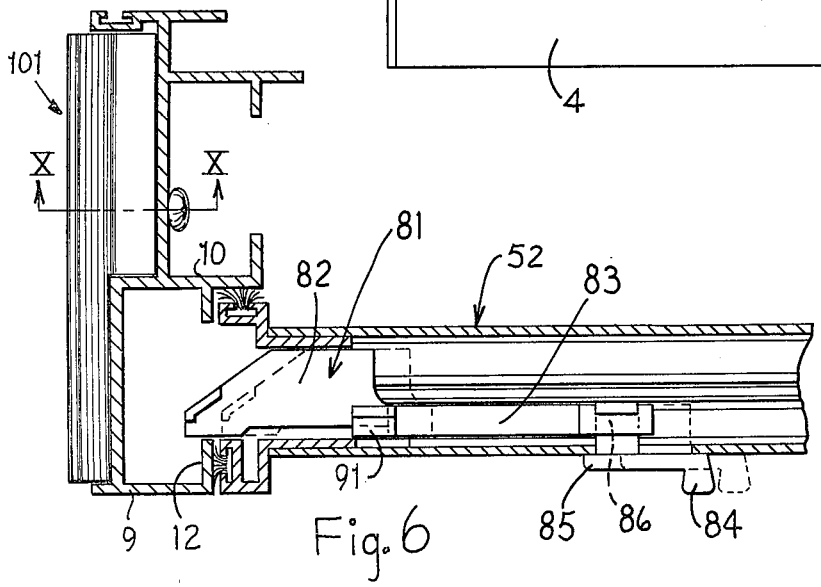
FIG. 6 is a fragmentary section taken on the line VI—VI of FIG. 1.
Figure 12:
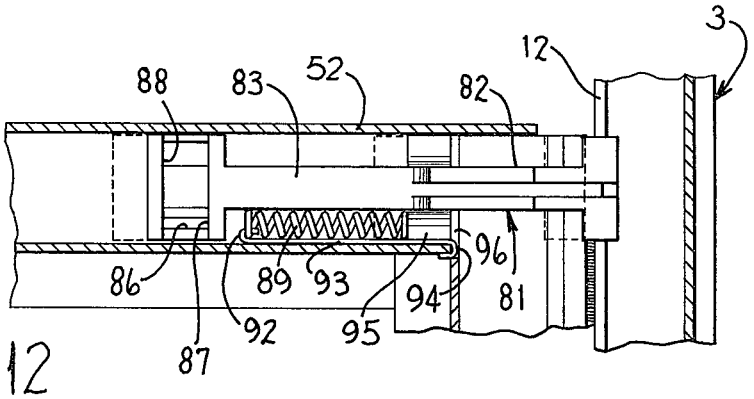
FIG. 12 is a fragmentary section taken on the line XII—XII of FIG. 6.

In this embodiment, although these details are not an essential part of the invention, the handle extension 84 (FIGS. 6, 9 and 12) is on a portion of a slide member 85 having prongs 86 thereon which latter project through openings such as openings 87 or 88, depending upon the alignment of the parts, for engaging the latch member 81. The resilient means 89 may be of any convenient form constantly urging the latch member 81 laterally outwardly and in this embodiment consists of a spring which bears at its rightward end (as appearing in FIGS. 9 and 12) against a downwardly projecting abutment 95 (FIG. 12 a similar upwardly projecting abutment being shown at 91 in FIG. 9) and is held at its leftward end by the hook 92 of the spring bar 93. The hook 94 of such spring bar is fixed through a suitable opening 96 (FIG. 12) to an edge of the upper cross member 52, thus the latch member 81 is constantly urged laterally outwardly by the spring 89 but can be manually retracted by finger engagement of the handle extension 84.

In its outward position, the latch portion 82 engages the flange 12 (FIG. 6) of a frame stile and holds said lower sash against pivoting from its closed position. By retracting said latch members 81 toward each other by appropriate manipulation of the handle extensions 84, said window may be released from its closed position and swung downwardly and inwardly about the pivots provided by the cam members 67 of the slide, or sash support, units 60. Upon so moving same downwardly and inwardly, the legs 64 and 66 of the units 60 are spread for effecting braking of the lower sash member snugly against and with respect to the frame of said window structure.

Similar latch members are provided at the upper end of the upper sash but being identical with that shown for the lower sash, it is not necessary to further describe same.

Figure 10:
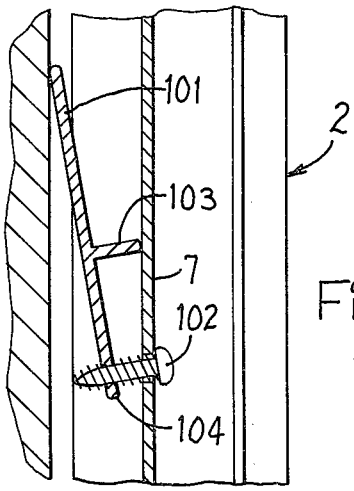
FIG. 10 is a section taken on the line X—X of FIG. 6.

Inasmuch as window openings, particularly in old brick buildings, often have slightly concave vertical sides, it is usually necessary to insert small shims between the window frame and the surface defining the window opening, often at a point approximatey midway between the upper and lower end thereof. This is a time consuming process and often requires skill and attention which in many window installing situations is not forthcoming. Therefore, and looking now at FIG. 10, there is provided a means by which the same effect as such shimming can be accomplished quickly and easily and same can be accomplished from the inside of the window frame. In said figure, there is shown a plate 101 held by a screw 102 extending through the step 7 on the outside of the window frame as shown. The screw 102 is threaded into one end of the plate 101 and a fulcrum is provided by the flange 103. Thus, rotation of said screw appropriately will draw the end 104 of said plate inwardly and thrust the other end thereof outwardly. This urges the center of the vertical frame stile inwardly with the same result as shimming thereof. By thus insuring that the vertical stiles are straight, the smooth sliding of the windows therein is enhanced.

Figure 13:
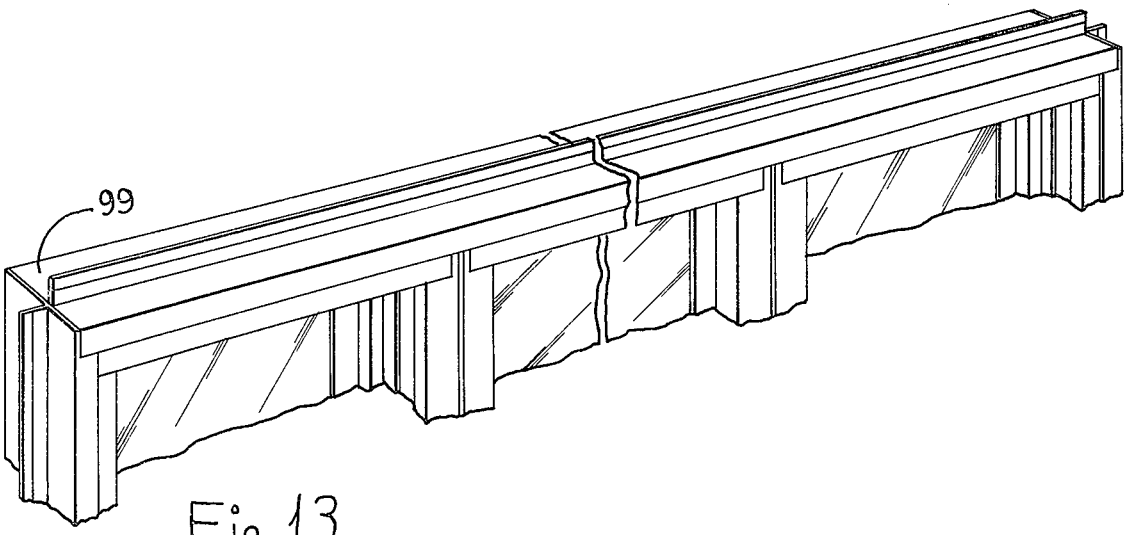
FIG. 13 is a fragmentary oblique view of a cap for holding a group of windows together.
Figure 7:
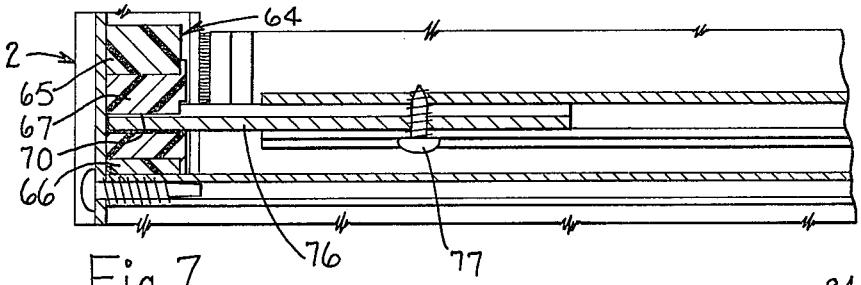
FIG. 7 is a fragmentary section taken on the line VII—VII of FIG. 2.
Figure 11:
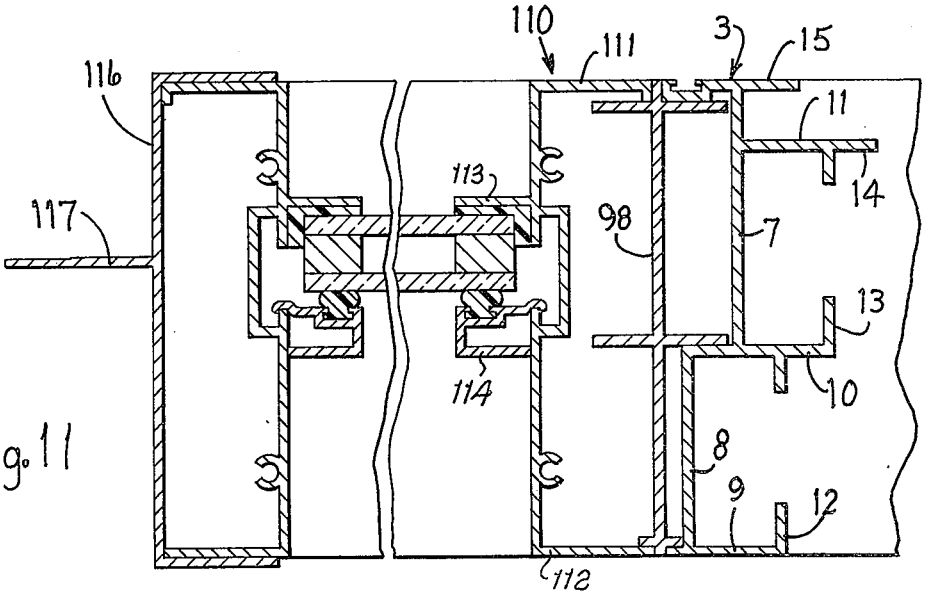
FIG. 11 is a section taken essentially on a line corresponding to FIG. 3A but with the sash removed and showing the connection thereof to an adjacent picture window.
Figure 14:
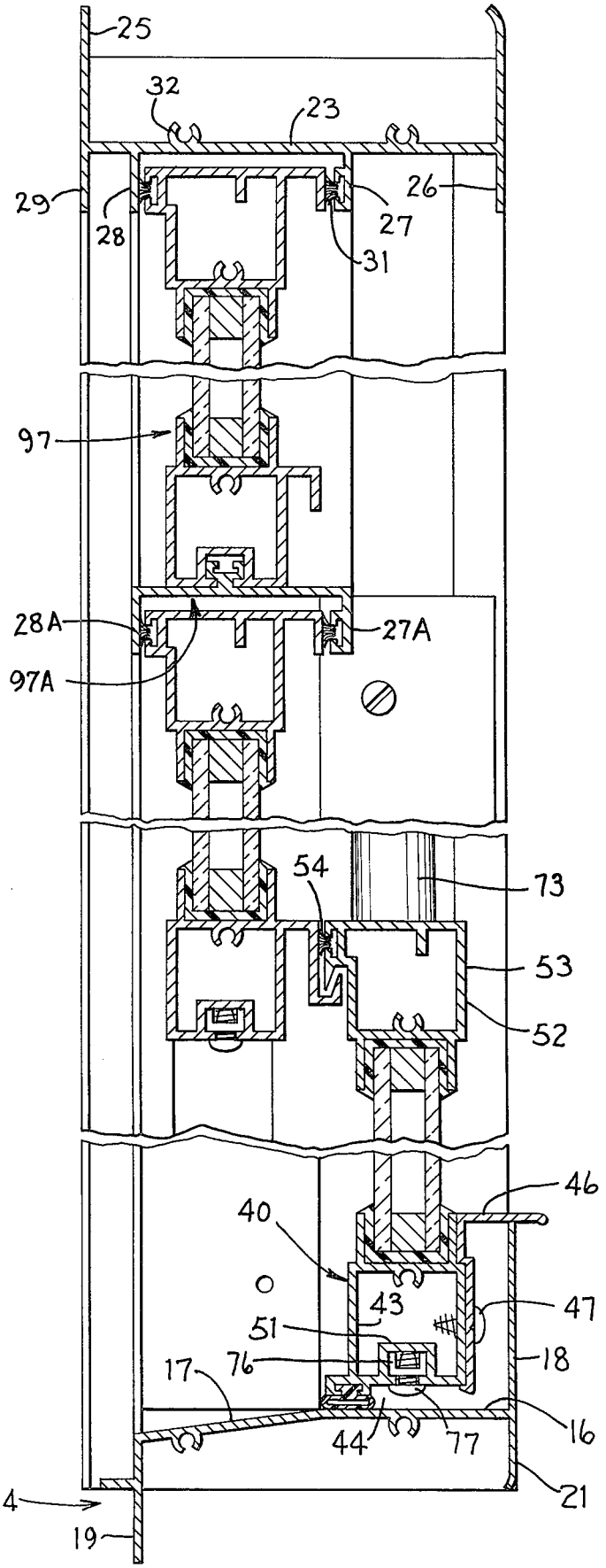
FIG. 14 illustrates a modification by a section similar to that of FIG. 2.

FIGS. 11, 13 and 14 illustrate the adaptability of the present window construction to some of a variety of installation situations.

FIG. 11 shows the use of a mullion 98, having on one side thereof a stile 3 of the double-hung window as above described, and on the other side thereof a generally U-shaped frame member, or stile, 110 as shown which has a pair of flanges 111 and 112 on one side thereof for fitting against said mullion and a pair of flanges 113 and 114 on the other side for holding a closure panel, such as a picture window.

FIG. 11 also shows the provision of a simple nailing strip 116 which embraces the window and provides a fin 117 for use in nailing the entire window unit into a wooden frame structure, as a frame structure within a window opening defined by brick walls.

FIG. 13 shows the use of the window of the invention with a cap 99 for connecting either a plurality of windows as herein described or such windows together with other units, such as a picture window, by which same are held firmly with respect to each other when several windows are placed side by side to fill a large window opening.

FIG. 14 illustrates the double-hung window above described installed into a frame including also a fixed window 97 whose bottom surface 97A acts in effect as the header 6 described in connection with the preceding figures. Flanges 28A and 27A in FIG. 14 correspond to flanges 28 and 27 in FIG. 2.

Other combinations, adaptations and installation techniques may be adopted with the window of the invention and it will be found to be an extremely versatile window capable of a wide range of uses.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a tilt-in-type window insertable in a window opening and having a metal frame and sash, the combination comprising:

a frame having a pair of upstanding stiles laterally opposed to each other in said window opening;

a said stile having a stepped transverse end wall, and uniformly spaced and parallel inside, middle and outside flanges extending laterally inboard from said end wall toward the other stile, said stepped end wall comprising an outside traverse web, an inside transverse web offset laterally outboard therefrom and a lateral step joining the adjacent ends thereof and formed by the laterally outer end portion of said middle flange, said flanges and end wall forming a pair of U-shaped sections opening laterally inboard with the legs of the U-shapes formed by said flanges, the interior one of said U-shaped sections being offset laterally outboard with respect to the exterior U-shaped section along a common leg formed by said middle flange;

said stile further comprising a pair of coplanar transverse flanges in each U-shaped section and spaced laterally inboard from said end wall by a common spacing and closing the outboard portion of the corresponding U-shaped section except for a slot between the opposed edges of such pair of transverse flanges, so as to define an undercut upstanding slideway in the outboard portion of each U-shaped section, said transverse flanges of said interior U-shaped section being offset laterally outboard of the transverse flanges of said exterior U-shaped section, the inboard edge of said inside flange carrying one said transverse flange, said middle flange carrying a second said transverse flange offset outboard of its laterally inboard edge by an interior facing sealing surface and carrying a third said transverse flange at its inboard edge, said outside flange carrying the fourth said transverse flange offset outboard from its laterally inboard edge by an interior facing sealing surface, the inboard faces of said first and third transverse flanges being further sealing surfaces, such that said U-shaped sections each have a said interiorly facing sealing surface on the exterior-most leg thereof and a laterally inboard facing sealing surface on the interior-most transverse flange thereof, wherein said sealing surfaces are arranged in a stairstep-like series proceeding interiorly and laterally outboard on said stile;

double-hung interior and exterior sash units respectively disposed between the laterally opposed interior U-shaped sections and exterior U-shaped sections of said stiles, the sides of said sash units each having, in cross section, an interior leg terminating in a laterally outboard facing seal strip sealingly opposed to said interior sealing surface of said transverse flange of the corresponding U-shaped stile section, and an exterior leg terminating immediately laterally inboard of the exterior transverse flange of said U-shaped section and having an exterior facing sealing strip engaging the adjacent and overhanging interiorly facing seal surface of the corresponding said U-shaped stile section, said sash units carrying glazing of substantially the same width from which said legs extend laterally outboard, said legs of said interior sash unit being longer than said legs of said exterior sash unit, such that each sash unit is freely shiftable interiorly from between said stiles despite positive sealing of each sash unit edge at two spaced locations in two mutually orthogonal planes respectively extending parallel to and perpendicular to the plane of said window;

sash support means vertically slidably housed in said undercut upstanding slideway of a said U-shaped stile section and means extending through the said slot and connecting the lower portion of a said sash to the adjacent support means, said support means including lock means permitting interior tilting of said sash unit while locking same against vertical sliding;

a laterally slidable latch member at the upper portion of a said sash unit extensible through said slot and into engagement with the interior one of the transverse flanges of the opposed U-shaped stile section to limit said sash unit to vertical sliding motion and retractable from said slot inboard beyond said last mentioned transverse flange for free pivoting of said sash unit interiorly from said stile, wherein during said pivoting the exterior and interior seal strips of the sash respectively move away from and slidably along the opposed seal surfaces of the adjacent U-shaped section, said latch member holding said seal strips snugly in position against said seal surfaces of said stile in the normal upright condition of said sash, the exterior one of said sashes being freely tiltable interiorly in laterally spaced relation from said interior U-shaped stile section.

2. The device of claim 1 in which each said sash has a substantially box section upper cross member including a bottom wall terminating in an end edge spaced laterally inboard from the stile and a top wall overlying said end edge:

said latch member including an elongate slide portion disposed in said upper cross member and having vertically extending abutments at the inboard and outboard ends thereof engageable with the wall of said upper cross member for slidably guiding said latch member for movement toward and away from the adjacent stile, a substantially S-shaped bar hooked over said end edge and extending inboard within said upper cross member and having a hook on its inboard end spaced between said abutments of said latch member, and a compression spring means extending along said S-shaped bar and latch member in trapped relation between said hook and outboard abutment for urging said latch member laterally outboard, said latch member including a latch portion extending outboard from said slide portion and having an interiorly facing edge which in the outboard extending position of said latch member extends into said slot and snugly opposes the exterior edge of the interior transverse flange of the adjacent U-shaped stile section.

3. The device of claim 2, including a laterally elongate opening in the interior wall of the sash upper cross member, a slide member slidable on said interior wall and having headed prong means extending loosely through said elongate opening and snap fitted in corresponding opening means in said abutment of said latch member, said slide member including a handle manually engageable for inboard sliding release of said latch member from said stile, whereby latch assembly can be readily completed by insertion of said latch member laterally into said sash upper cross member and insertion of said prong means through said sash wall opening into snap fitted relation with said latch member.

4. The device of claim 3, in which said top and bottom walls of said upper cross member carry opposed fins extending longitudinally of said upper cross member and directed into the space therein, said slide portion of said latch member being slidably sandwiched between said fins and the interior side wall of said upper cross member, said latch portion of said latch member being platelike and extending outboard beyond said fins and having its outboard edge angled exteriorly and toward the central portion of said window sash.

5. The device of claim 1, including a plate disposed outward of said transverse end wall of said stile but lying inboard of the side of a window opening in a building wall in which said window is to be located, said plate having upper and lower edges and a flange spaced between said edges of said plate and extending rigidly and transversely from said plate into edge contact with a said web of said stile, a screw extending outboard through said stile web and threadedly engaging said plate between said flange and one said edge for pulling said one edge inboard toward said web upon tightening of said screw, the other said edge of said plate being engageable with the surface of said building wall opening such that tightening of said screw rocks said plate on the inboard edge of said flange to push said other plate edge against the surface of the building opening and thereby prevent outboard bowing of said stile despite bowing of the surface of the window opening of the building.

6. The device of claim 5, in which the building engaging edge of said plate extends substantially the full transverse width of said stile and overlaps the webs of both said U-shaped stile sections, said flange and the screw engaged edge portion of said plate being of of reduced transverse width to engage the web of only the laterally inboard one of said U-shaped stile sections.

7. The device of claim 1, in which said lateral step in said stile end wall is the laterally outboard end of said middle flange, said stile end wall extending exteriorly beyond said outside flange and terminating in an external face flange, said inside flange extending outboard somewhat beyond the stile end wall, said window including a mullion having a transverse central web extending the transverse width of said stile and having three transversely spaced and laterally extending cross flanges intermediate its interior and exterior edges and being snugly overlapped by, respectively, said exterior stile flange, said inside stile flange extension and said middle stile flange, and including an adjacent further window stile from which interior and exterior flanges laterally extend substantially in coplanar relation with the inside and external face flanges of the first mentioned stile and snugly overlapping at least said interior and exterior flanges of said mullion, whereby said mullion retains two adjacent window units against relative transverse shifting, the interior and exterior extremities of said transverse mullion plate being exposed between and laterally abutted by the opposed edges of the interior and exterior flanges of said window stiles.

8. The device of claim 1 wherein said connecting means comprise retractable pins whereby upon retraction of said pins and retraction of said latch members said sash may be removed bodily from connection with said frame.

9. The device defined in claim 1 including a generally U-shaped receptacle for receiving thereinto the peripheral edge of a window unit and a nailing fin extending outwardly therefrom in a direction parallel to the plane of the window and available for affixing, as by nails or by screws, the window unit to a building.

10. In a tilt-in-type window having a metal frame and sash, the combination comprising:

a first window frame locatable in the window opening of a building wall, said frame comprising a pair of opposed, upstanding stiles for carrying double-hung sash, a given said stile having, in cross section, a transversely extending and laterally outboard end wall extending the width of the stile and having an intermediate step parallel to the plane of the window opening and facing externally thereof, said stile cross section further having laterally extending exterior and inside flanges at the exterior and inside edges of said end wall;

a second window frame in said window opening and disposed beside said first window frame, said second window frame having an opposed pair of stiles including a transverse wall from the inside and exterior edges of which laterally outboard extend corresponding exterior and inside flanges having exterior and inside faces coplanar with those of the exterior and inside flanges of the opposed stile of said first window frame;

a mullion interposed between the stiles of the two window frames and comprising a transversely extending plate having exterior and inside edges snugly sandwiched between the opposed edges of said exterior and inside flanges of said stiles of said first and second window frames, said mullion further having interior and exterior cross flanges parallel to the plane of the window and respectively disposed immediately behind and between the stile flanges in transversely backing engagement therewith so as to reinforce said stile flanges and preclude transverse offsetting of one of said frame with respect to the other, said mullion further including a laterally extending intermediate cross flange additionally backing the exteriorly facing step of the first mentioned stile.

11. The device of claim 10, including a channel cross section strip opening toward and receiving therein the furtherest outboard stiles of said window frames in said window opening and further continuing at least along the top of said frames to further join same as a single unit, the bight portion of said channel-shape having a planar nailing strip extending outboard therefrom parallel to the plane of the window opening and spaced intermediate the interior and exterior edges of such channel shape for securing the several window frames to an exterior face of the building.

12. A tilt-in-type window having a metal frame and sash and comprising:

a frame having a laterally opposed pair of upright stiles each including interior and exterior box sections arranged side-by-side and having upstanding slots facing the center of the window, said box sections each having a laterally inboard wall in the form of transverse flanges at the exterior and interior sides of said slot;

a double-hung pair of sashes respectively disposed between the interior and exterior box sections of said stiles and laterally facing said slots, each said sash having a box section upper cross member including a bottom wall terminating in an end edge spaced laterally inboard from the stile and a top wall overlying said end edge;

means in said box section and connected to the bottom portion of each sash for (1) vertically slidably guiding the sash and for (2) permitting interior pivoting thereabout of said sash for washing or the like to a substantially horizontal position;

a latch member including an elongate slide portion disposed in said upper cross member and having vertically extending abutments at the inboard and outboard ends thereof engageable with walls of said upper cross member for slidably guiding said latch member for movement toward and away from the adjacent stile, a substantially S-shaped bar hooked over said end edge and extending inboard within said upper cross member and having a hook on its inboard end spaced between said abutments of said latch member, and a compression spring means extending along said S-shaped bar and latch member in trapped relation between said hook and outboard abutment for urging said latch member laterally outboard, said latch member including a latch portion extending outboard from said slide portion and having an interiorly facing edge which in the outboard extended position of said latch member extends into said slot and snugly opposes the exterior edge of the interior transverse flanges of the adjacent stile section, a laterally elongate opening in the interior wall of the sash upper cross member, a manually engageable slide member slidable on said interior wall and having means extending loosely through said elongate opening fixed to said abutment of said latch member for limiting outboard latch member travel and for inboard sliding release of said latch member from said stile.

13. In a metal frame window, frame means including sash receiving means and sash received within said sash receiving means, means effecting alignment of said frame with respect to the surface defining a window opening comprising:

a metal plate positioned adjacent the outboard face of said metal frame intermediate the ends thereof and in between said frame and the peripheral surface of the window opening, said plate including an intermediate flange extending therefrom to engage said frame;

threaded means engaging a selected portion of said frame and further engaging a portion of said metal plate spaced between said flange and one edge of said plate;

whereby rotation of said threaded means will pivot said metal plate on said flange as a fulcrum to move the opposite edge of said plate away from said frame and against the adjacent peripheral surface defining a window opening whereby to selectively adjust the lateral spacing between said selected portion of said frame and the peripheral surface opposite thereto defining said window opening.

* * * * *